United States Patent [19]

Liu

[11] Patent Number: 4,885,446

[45] Date of Patent: Dec. 5, 1989

[54] LOAD-RESPONSIVE MICROWAVE OVEN TURNTABLE

[76] Inventor: Yiu-Ching Liu, 973 Shulman Ave., Santa Clara, Calif. 95050

[21] Appl. No.: 277,996

[22] Filed: Nov. 30, 1988

Related U.S. Application Data

[63] Continuation-in-part of Ser. No. 169,747, Mar. 16, 1988, Pat. No. 4,808,781.

[51] Int. Cl.[4] ..... H05B 6/78

[52] U.S. Cl. ..... 219/10.55 F; 219/10.55 R; 219/518; 108/20; 108/142; 99/443 R

[58] Field of Search ..... 219/10.55 E, 10.55 F, 219/10.55 R, 518; 108/20, 139, 142; 99/443 R; 126/338

[56] References Cited

U.S. PATENT DOCUMENTS

| | | | |
|---|---|---|---|
| 3,300,615 | 1/1967 | Smith | 219/10.55 F |
| 4,330,696 | 5/1982 | Pomeroy et al. | 219/10.55 F |
| 4,427,876 | 1/1984 | Bonacorsi | 219/413 |
| 4,456,805 | 6/1984 | Jorgensen et al. | 219/10.55 F |
| 4,625,087 | 11/1986 | Jorgensen et al. | 219/10.55 E |
| 4,629,846 | 12/1986 | Dilyard | 219/10.55 F |
| 4,694,132 | 9/1987 | Liu | 219/10.55 F |
| 4,724,292 | 2/1988 | Ichikawa | 219/10.55 B |
| 4,746,781 | 5/1988 | Dalquist, III et al. | 219/10.55 F |

*Primary Examiner*—Philip H. Leung

*Attorney, Agent, or Firm*—Thomas Schneck

[57] ABSTRACT

A microwave oven turntable having a load-responsive mechanism for self-activating the turntable upon the placement of foodstuff thereon. The turntable includes a base assembly having a planar bottom and upwardly extending sides to form a base interior in which a drive shaft is rotatably driven by a coil spring. A tabletop is coupled to the drive shaft for rotation therewith, but the rate of rotation is determined by the cyclical motion of a governor. The load-responsive mechanism includes a resilient brake member which is aligned in a governor-locking position. The tabletop is linked to the brake member by an actuator and the brake member is sufficient rigid to maintain the actuator and tabletop in a slightly uplifted condition when in the governor-locking position. The placement of foodstuff on the tabletop, however, provides a gravitational force which displaces the brake member into a governor-releasing position in spaced apart relation to the governor.

11 Claims, 3 Drawing Sheets

LOAD-RESPONSIVE MICROWAVE OVEN TURNTABLE

CROSS REFERENCE TO RELATED APPLICATION

This is a continuation-in-part application of prior co-pending application Ser. No. 169,747, filed Mar. 16, 1988, now U.S. Pat. No. 4,808,781.

1. Technical Field

The present invention relates generally to turntables and in particular to portable microwave oven turntables for rotating food cooking within a microwave oven.

2. Background Art

Microwaves injected into the interior of a microwave oven rebound about the walls and door of the interior. As a result, the microwaves sometimes interfere with one another to produce cold spots or strengthen one another to produce hot spots. These cold spots and hot spots vary depending upon the cookware inserted into the microwave oven. To compensate for this non-uniformity of energy distribution a number of microwave oven turntables have entered the market. For example, U.S. Pat. No. 4,694,132 to Liu discloses a portable microwave oven turntable that includes a removable tabletop driven at various points at or near its circumference. The removable tabletop permits easy inspection and cleaning of certain internal workings.

Typically, a portable microwave oven turntable is rotatably driven by a coiled spring motor which is wound in one direction in order to provide rotation in the opposite direction. The turntable is able to operate for several minutes and usually includes an on-off mechanism. While gravity activation of a turntable is known, most microwave oven turntables include a manually operated on-off mechanism. Such manual mechanisms have proved to be inconvenient, especially after the turntable has been inserted into the confines of a microwave oven turntable.

It is an object of the present invention to provide a microwave oven turntable which is automatically operated. It is a further object to provide such a turntable having an on-off mechanism which is reliable but is inexpensively built with a minimum number of components.

DISCLOSURE OF THE INVENTION

The above objects have been met by a portable microwave oven turntable that includes a load-responsive mechanism for initializing turntable rotation. The load-responsive mechanism has a flexible brake member which is in vertical motion transfer engagement with a tabletop of the microwave oven turntable.

The turntable includes a base assembly having a planar bottom and upwardly extending sides to form a base interior for housing a drive shaft and a spring motor which provides rotational motion to the drive shaft. The upper extent of the drive shaft is coupled to a tabletop adapted to support foodstuff to be heated. Also within the base interior is a gear train having a governor which is limited to cyclical motion so as to regulate the rate of rotation of the drive shaft. Typically, the cyclical motion is a reciprocating motion.

The brake member has a fixed end mounted to the planar bottom of the base assembly and has a free end. The brake member is aligned so that the free end is in contact with the governor to prevent the cyclical motion. In this governor-locking position the drive shaft is prevented from rotating. The brake member, however, is connected to the lower end of an actuator having an upper end contacting the tabletop. In the governor-locking position the brake member is sufficiently rigid to support the actuator and the tabletop in a slightly uplifted condition. But placement of foodstuff or other load on the tabletop flexes the brake member, lowering the brake member to a governor-releasing position. In this position, the brake member is spaced apart from the governor, thereby permitting rotation of the drive shaft and the tabletop.

An advantage of the present invention is that the microwave oven turntable may be activated merely by the placement of foodstuff on the tabletop. Thus, it is not necessary to manually operate an on-off mechanism which may be difficult to reach once the turntable is placed in the confines of a microwave oven. Another advantage is that the load-responsive mechanism requires only a minimum number of parts so that the mechanism is both reliable and cost-efficient.

BEST MODE FOR CARRYING OUT THE INVENTION

Figure 1:
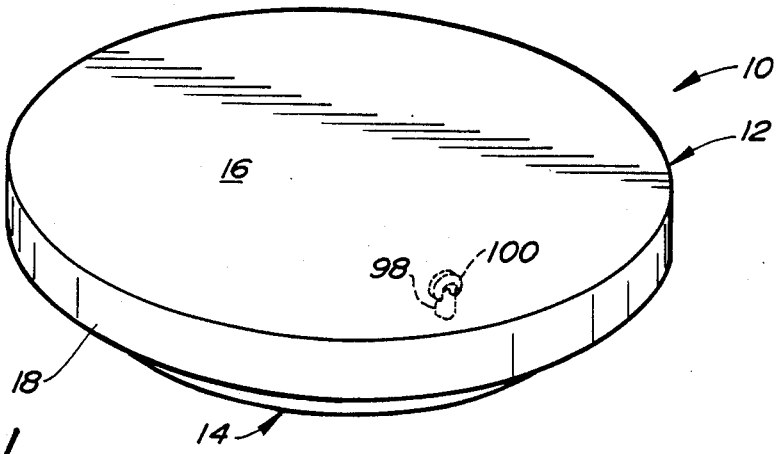
FIG. 1 is a top perspective view of a turntable in accord with the present invention.
Figure 2:
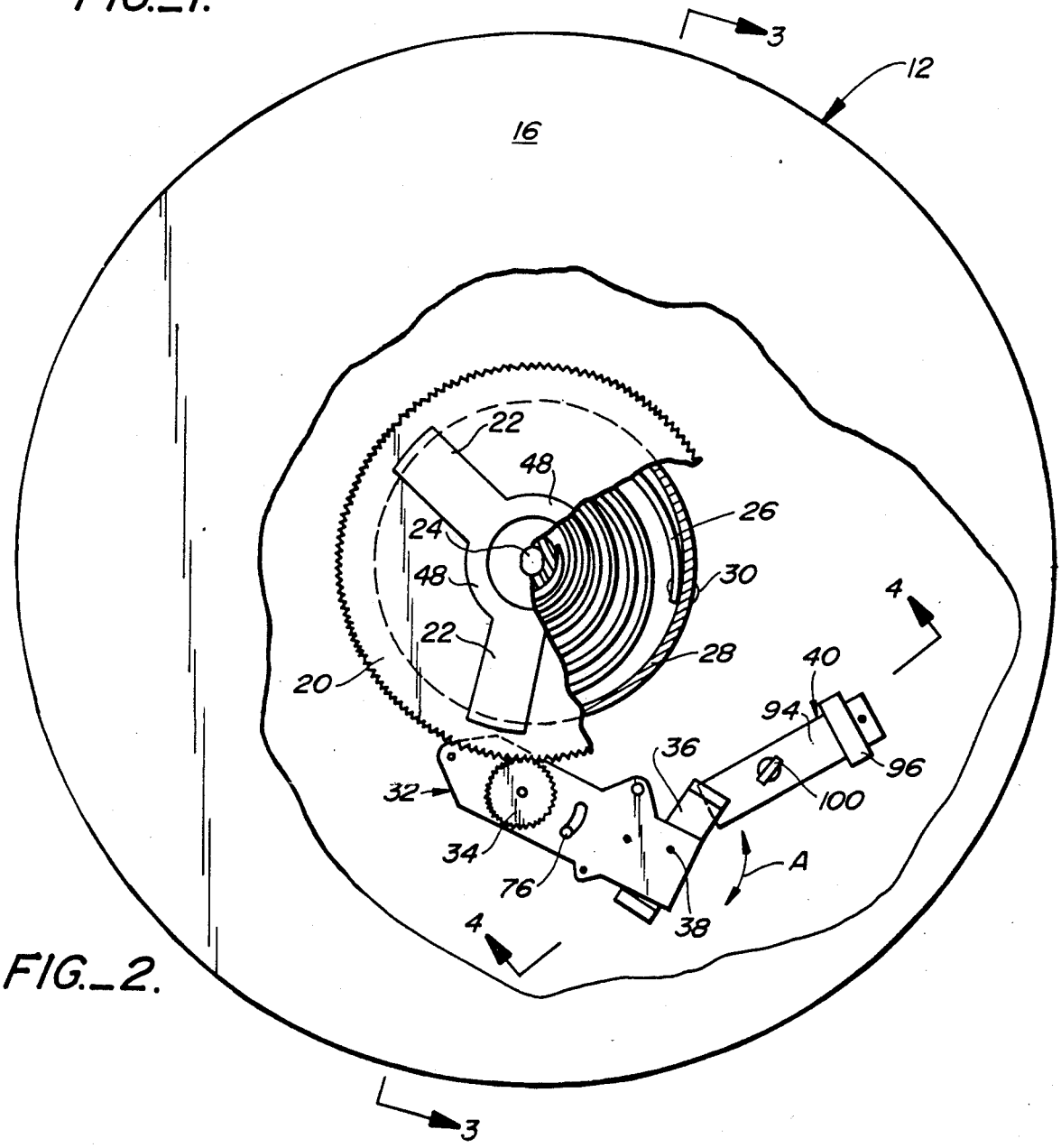
FIG. 2 is a top partially cutaway view of the turntable of FIG. 1.

With reference to FIGS. 1 and 2, a microwave oven turntable 10 has a tabletop 12 and a base assembly 14. The tabletop includes a circular platform 16 and a cylindrical sidewall 18 depending from the circular platform. The tabletop is made of a low-loss plastic material which is generally transparent to microwaves.

Atop the base assembly 14 is a main drive gear 20. The drive gear 20 includes a plurality of radial arms 22. As will be explained more fully below with reference to FIG. 3, the radial arms 22 mesh with projections depending from the tabletop 12 so that rotation of the drive gear is translated to the tabletop.

The rotational drive for the tabletop 12 is provided from within the base assembly 14. The drive gear is snuggly fit to a drive shaft 24. A coil spring 26 has a first end which is fixed to the drive shaft 24 and a second end fixed to a spring housing 28 by a rivet 30 or any other means of securely attaching a spring. When the spring is tightly wound, the drive shaft is urged to rotate about a vertical axis passing through the drive shaft. In operation, energy for tabletop rotation is stored in the coil spring 26 by twisting the tabletop 2 with respect to the base assembly 14. Rotation of the tabletop in a counterclockwise direction wraps the coil spring tightly around the drive shaft. Then, upon release of the tabletop, the coil spring urges the drive shaft in a clockwise direction. The drive shaft, the drive gear 20, and the tabletop are thereby caused to rotate.

A coil spring 26 which is tightly wound will unwind quickly when released, unless a mechanism governs the speed of the unwinding action. That is, unless a mechanism is provided to govern the speed at which the coil spring 26 unwinds, the tabletop 12 will spin out of control when the coil spring is wound and then released. The tabletop is prevented from uncontrollably spinning by a gear train assembly 32. The gear train assembly is a gear step-up transmission mechanism having an input gear 34 in meshing engagement with the drive gear 20. Since the drive gear 20 is coaxially fixed to the drive shaft 24, the drive shaft and tabletop will rotate only as quickly as the gear train assembly permits.

A governor 36 ultimately determines the rate of rotation of the input gear 34. The governor is a reciprocating member which employs cyclical motion about a vertical axis 38 at the midpoint of the governor 36. The cyclical reciprocating motion is indicated by arrow A. As will be explained more fully below, a load-responsive mechanism 40 acts as a brake for the governor 36, thereby selectively locking the tabletop 12 in position.

Figure 3:
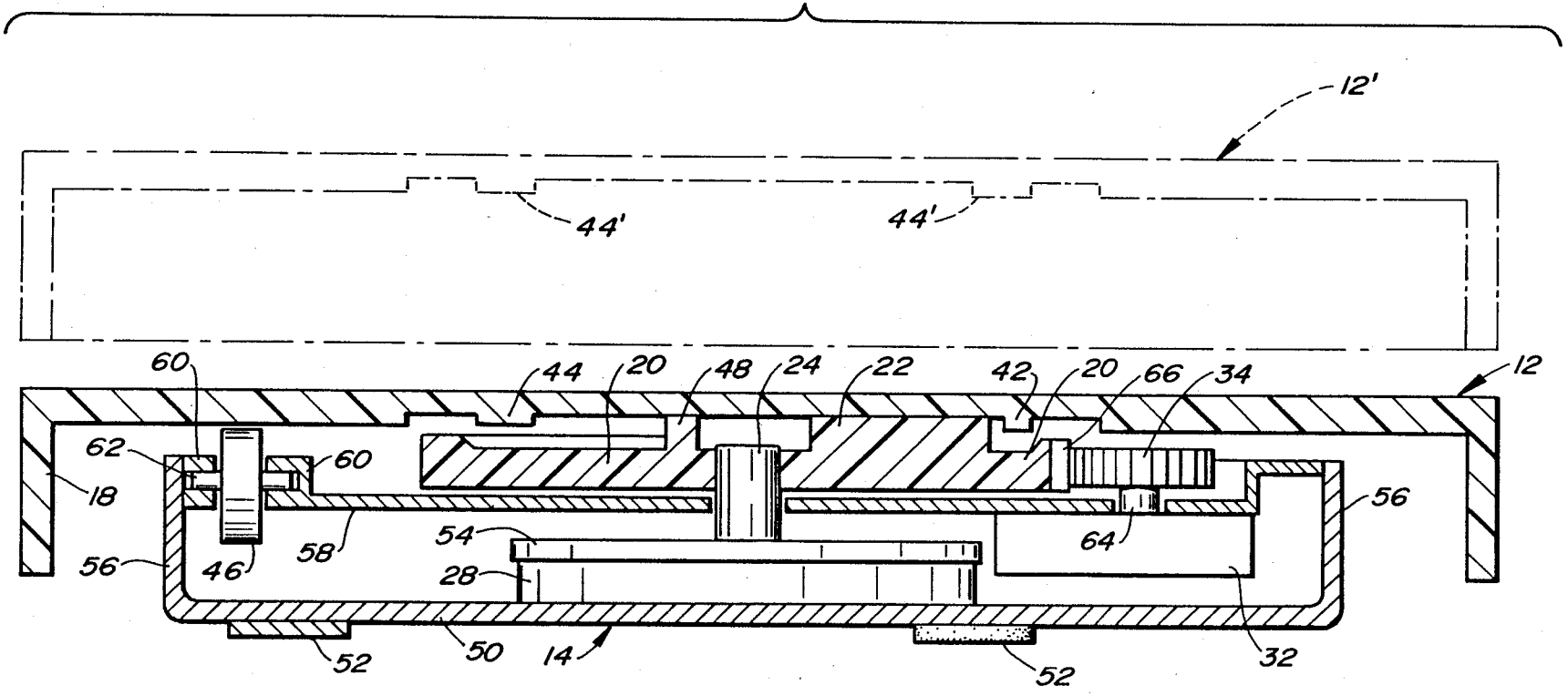
FIG. 3 is a side sectional view taken along lines 3—3 in FIG. 2.

Referring now to FIGS. 2 and 3, the downwardly depending cylindrical sidewall 18 of the tabletop 12 has a diameter exceeding the diameter of the base assembly 14. The tabletop will therefore extend over the base assembly. An annular hub 42 is concentric with the cylindrical sidewall 18. An array of projections extend downwardly from the tabletop 12 and radially inwardly from the hub 42 to produce an array of teeth 44. The hub and teeth structure is described in more detail in the parent application, Ser. No. 169,747 ,now U.S. Pat. No. 4,808,781 which is incorporated by reference.

The tabletop may be removed from the base assembly 14 by lifting, as shown in 12' of FIG. 3. When brought into contact with the base assembly, the mass of the tabletop is supported at specific areas. Firstly, the tabletop 12 is in contact with freely rotating wheels 46, only one of which is shown in FIG. 3. The wheels 46 are three in number and are spaced apart by 120 degrees to ensure an even distribution of weight. The tabletop 12 secondly contacts an annular region 48, shown in FIGS. 2 and 3, from which the radial arms 22 radially project. Lastly, the mass of the tabletop is supported on the radial arms 22. Moreover, the outermost ends of the radial arms 22 fit between adjacent teeth 44 of the tabletop. The lateral edges of the teeth 44 engage the lateral edges of the radial arms 22. Thus, rotation of the radial arms causes rotation of the tabletop 12.

As noted above, the rotational drive of the radial arms 22 is provided from within the base assembly 14. The base assembly includes a circular, horizontal plate 50 which rests on a plurality of feet 52. The spring housing 28 is attached to the circular base plate 50. Within the spring housing is a stud, not shown, which projects upwardly from the base plate 50. The central drive shaft 24 is rotatably fitted over the stud. The coil spring 26 has opposite ends fixed to the spring housing 28 and the drive shaft 24. A housing cover 54 shields the coil spring from microwaves.

The base assembly 14 has a cylindrical sidewall 56 extending upwardly from the base plate 50. A base cover member 58 is supported atop the base assembly by the sidewall. The three freely rotating wheels 46 are fixed to the base cover member 58 by lips 60 which trap an axle 62 against the base cover member. A wheel 46 is positioned such that the upper portion of the wheel extends above the surface of the base cover member.

Figure 4A:
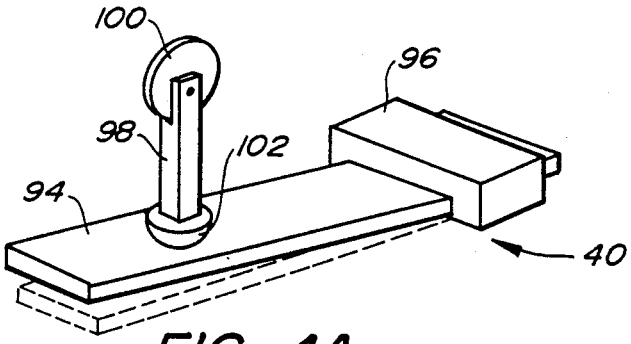
FIG. 4A is a perspective view of the load-responsive mechanism of FIG. 4.
Figure 4:
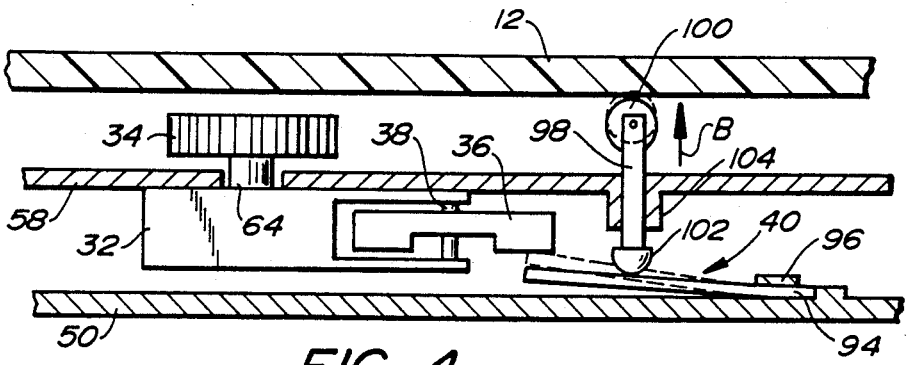
FIG. 4 is a side sectional view taken along lines 4—4 of FIG. 2.

The drive shaft 24 extends from the base interior through an aperture in the base cover member 58 to rotate the central drive gear. As shown in FIGS. 3 and 4, a gear shaft 64 extends from the gear train assembly 32, through a second aperture within the base cover member 58, to the input gear which has teeth which mesh with the teeth 66 of the drive gear 20.

Figure 5:
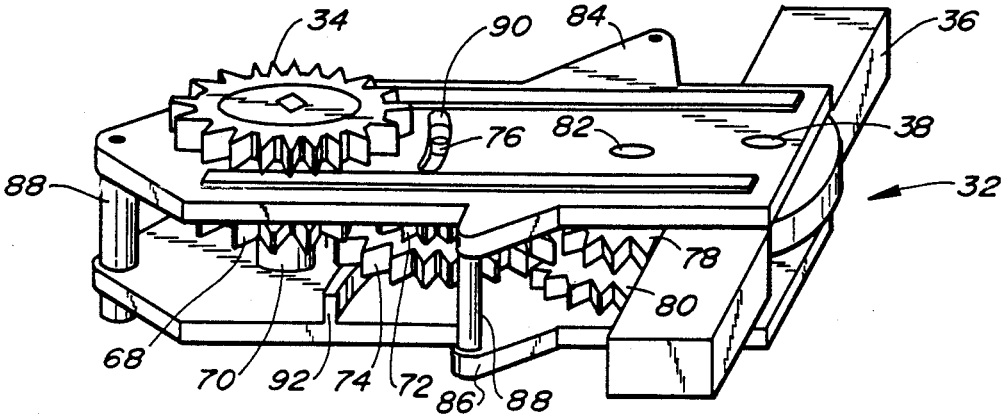
FIG. 5 is a perspective view of the gear train of FIG. 2.

The gear train assembly 32 will be explained with reference to FIGS. 4 and 5. In a gear step-up transmission, the speed of input gear 34 rotation is multiplied by each succeeding gear. The input gear 34 is mounted coaxially with an escapement gear 68 on a shaft 70. The escapement gear 68 meshes with an idler gear 72 that is coaxial with an intermediate gear 74 on a shaft 76. The intermediate gear 74 then meshes with a second idler gear 78 that is coaxial with a ratchet gear 80 on a shaft 82.

The governor 36 has two pawls, not shown, meshing with the ratchet gear 80 at different points. A first pawl completely meshes with the teeth of the ratchet gear only when the second pawl is freed from the ratchet gear. The second pawl completely meshes only when the first pawl is freed from the ratchet gear. Thus the governor oscillates back and forth as the ratchet gear 80 rotates, and the permissible speed of gear rotation is determined by the cyclical reciprocating motion of the governor 36 about the vertical axis 38.

Shaft 70, 76 and 82 are held between a pair of plates 84 and 86. The plates are spaced apart by posts 88. Each plate 84 and 86 has an elongated slot 90 through which the shaft 76 is slidably fit. When the input gear 34 is caused to be rotated in a counterclockwise, the escapement gear 68 forces the shaft 76 to one end of the slot 90. In this position the intermediate gear 74 meshes with the ratchet gear 80. If however the input gear is rotated in a clockwise direction, as when the coil spring that drives the tabletop 12 is being wound, the shaft 76 is forced to the opposite end of the slot 90 whereupon the intermediate gear 74 no longer meshes with the ratchet gear 80. This construction prevents the governor 36 from impeding the speed at which the coil spring can be wound. A ridge 92 on the lower plate 86 ensures that the movable idler gear 72 remains on the same plane as the escapement gear 68.

Because the rate of rotation of the tabletop 12 is ultimately determined by the reciprocating motion of the governor 36, turntable rotation may be ceased by locking the governor 36 in position. The load-responsive mechanism 40 of FIGS. 4 and 4A is a self-acting device for braking of the tabletop 12. The load-responsive mechanism has a brake member 94 which is fixed to the base plate 50 by a mounting bracket 96. The brake member is made of a resilient material and has a free end opposite the mounting bracket 96. The brake member is aligned and biased so that the free end engages the governor 36. In the relaxed state shown in FIG. 4A, the brake member is in a raised, governor-locking position. When flexed to the governor-releasing position shown in FIG. 4, the brake member 94 provides an upward force on an actuator 98 in an attempt to return to the governor-locking position. This upward force is shown by arrow B.

The actuator 98 is a post having a freely rotatable wheel 100 at an upper end and an enlarged rounded surface 102 at a lower end. The actuator 98 slidably passes through a sleeve 104 in the base cover member 58. The sleeve acts as a bearing surface for vertical movement of the actuator.

In a relaxed state the load-responsive mechanism 40 is biased so that the brake member 94 contacts the governor 36, as shown by the dotted lines in FIG. 4. The brake member 94 is typically made of a plastic material and is sufficiently rigid to maintain the tabletop 12 in a slightly uplifted condition. The brake member, however, may be a metallic member since it is the elasticity of the material and not the type of material which is of concern. The contact of the brake member against the governor precludes operation of the gear train assembly 32 and, consequently, prevents rotational motion of the tabletop 12. However, placement of a load, such as foodstuff contained in a cooking dish, provides a gravitational force which pushes the brake member 94 to a governor-releasing position, and rotation of the tabletop follows. The freely rotatable wheel 100 facilitates movement of the tabletop relative to the actuator 98.

In operation, a user manually winds the microwave oven turntable 10 of FIGS. 1 and 2 by rotating the tabletop 12 relative to the base assembly 14. Rotation of the tabletop causes a tightening of the spring coil 26 that is attached to the drive shaft 24. The tightened coil spring stores energy for rotating the tabletop 12 and any foodstuff supported thereon after placement of the turntable 10 and foodstuff into a microwave oven.

The rate of release of energy from the coil spring 26 is determined by the gear train assembly 32 and the cyclical motion of the governor 36. Thus, the brake member 94 of the load-responsive mechanism 40 shown in FIGS. 2 and 4 acts to prevent tabletop rotation. The brake member is aligned to contact the governor 36 and is sufficiently rigid to support the actuator 98 and the turntable 12 in a slightly uplifted condition. However, the brake member 94 is lowered to a governor-releasing position by the placement of a load on the tabletop. Gravitational force bends the brake member so that it is spaced apart from the governor. Thus, after winding the coil spring 26 which drives the tabletop, the turntable may be inserted into a microwave oven and turned on and off merely by the placement and removal of foodstuff from the tabletop.

I claim:

1. A portable microwave oven turntable comprising, a base assembly having a planar bottom and upwardly extending sides to form a base interior, drive gear means coupled to the base assembly for rotation about a vertical axis, drive means for rotating the drive gear means about the vertical axis, a table top in rotation transfer engagement with the drive gear means, the table top being adapted to support a load, regulating means for controlling the rotational speed of the table top, the regulating means including a gear train and a governor, the gear train having an input end in engagement with the drive gear means and having an output end coupled to the governor, the governor employing cyclical motion to limit rotational speed at the input end, and load-responsive means disposed within the base interior and operatively coupled to the table top for selectively preventing the cyclical motion of the governor so as to inhibit rotation of said table top, the load-responsive means being associated with a first force which urges the load-responsive means into a locking relation with the governor to prevent the cyclical motion, the first force being overcome by gravitational force when the table top supports a load, thereby releasing the load-responsive means from the locking relation to permit the cyclical motion.

2. The microwave oven turntable of claim 1 wherein said load-responsive means has a locking member in a vertical motion transfer engagement with said table top, the locking member pivoting biased support to said table top to urge the table top in a slightly uplifted condition and to engage the cyclically moving governor so as to prevent said cyclical motion, placement of a load on said table top depressing the locking member to disengage the locking member from said governor.

3. The microwave oven turntable of claim 2 wherein said load-responsive means includes an actuator linking said locking member to said table top for translation of vertical motion.

4. The microwave oven turntable of claim 3 wherein said actuator has a freely rotatable wheel mounted thereto, the wheel being in contact with said table top and being aligned to facilitate said rotation of said table top.

5. The microwave oven turntable of claim 2 wherein said locking member is an elongated element having a first end fixed to said planar bottom and having a free end opposite said first end, said free end being aligned for said engagement with said cyclically moving governor.

6. The microwave oven turntable of claim 5 wherein said locking member is made up to resilient material sufficiently rigid to support said table top in said slightly uplifted condition prior to the placement of said load on the table top.

7. The microwave oven turntable of claim 1 wherein said cyclical motion of said gear train engages said governor in a manner to permit reciprocating motion.

8. A portable microwave oven turntable comprising, a base assembly having a planar bottom, upwardly extending sides and a circular base cover member attached to the sides of the base assembly to form a base cavity, the base assembly further having a spring motor within the base cavity and a drive shaft coupled to the spring motor for rotation about a vertical axis, the drive shaft extending upwardly through the base cover member and having a drive gear fixed thereto, a circular table top coupled to the drive shaft for rotation therewith, the table top being adapted to support a load, means for regulating the release of potential energy from the spring motor, the regulating means including a gear train coupled to the drive gear and a governor, the governor being in meshing engagement with said gear train in a manner to limit said governor to a back-and-forth motion, a locking member mounted within the base cavity and biased in a governor-locking position in which the locking member engages the governor, thereby preventing rotation of the table top, and an actuator linking the locking member to the table top, the bias of the locking member having a force to press the actuator in an upward direction to maintain the table top in an uplifted condition when the locking member is in the governor-locking position, the force being slightly greater than the gravitational force exerted on the locking member via the actuator, thereby allowing the locking member to be moved into a governor-releasing position when the table top supports a load.

9. The microwave oven turntable of claim 8 wherein said locking member has a fixed end mounted to said planar bottom of the base assembly and has a free end aligned for said engagement with the governor, said locking member being made of a resilient material to elastically deflect between said governor-locking position and said governor-releasing position.

10. The microwave oven turntable of claim 9 wherein said actuator is a rod having a lower end contacting said locking member and having an upper end, said upper end having a rotatably mounted wheel contacting said table top.

11. The microwave oven turntable of claim 8 wherein said table top is rested above said base cover in a freely rotatable manner.

* * * * *